United States Patent [19]

Mulcahy

[11] 4,147,237

[45] Apr. 3, 1979

[54] BRAKING SYSTEM AND METHOD FOR RAILROAD TRUCK

[75] Inventor: Harry W. Mulcahy, Griffith, Ind.

[73] Assignee: Amsted Industries Incorporated, Chicago, Ill.

[21] Appl. No.: 824,859

[22] Filed: Aug. 15, 1977

[51] Int. Cl.[2] ..... B61H 13/36; B61H 13/38

[52] U.S. Cl. ..... 188/52

[58] Field of Search ..... 105/182 R; 188/52, 53, 188/193

[56] References Cited

U.S. PATENT DOCUMENTS

| | | | |
|---|---|---|---|
| 2,892,515 | 6/1959 | Osner | 188/52 |
| 3,266,601 | 8/1966 | Taylor | 188/52 |

*Primary Examiner*—Robert G. Sheridan

*Attorney, Agent, or Firm*—John L. Schmitt; Fred P. Kostka

[57] ABSTRACT

A braking system for a railroad car truck having its front and rear wheelsets so connected to permit each wheelset to yaw as the truck proceeds about curved trackage includes a front and rear brake beam and brake shoes attached thereto for engagement with the front and rear wheelsets. Each brake beam is pivotally connected to a front and rear brake lever, respectively, which are in turn pivotally connected to a front and rear swingable arm of the truck. During yawing or horizontal rotational movements of the wheelsets and thd swingable arms in which the wheelsets are journaled, the brake beams and truck levers move complementary to each other so that when a braking force is applied to the truck levers, the rotational position of the wheelsets is unaffected by the braking force as the brake shoes engage the wheelsets.

8 Claims, 4 Drawing Figures

BRAKING SYSTEM AND METHOD FOR RAILROAD TRUCK

BACKGROUND OF THE INVENTION

1. Field of Invention

This invention relates to railroad car truck braking systems and more particularly to a braking system for a railroad truck having conjointly rotatable wheelsets.

2. Prior Art

Heretofore, one popular braking system for a railroad car includes an elongated front and rear brake beam having brake shoes mounted adjacent to each end and positioned to engage with a front and rear wheelset of the car truck. Ends of the brake beam are slidably carried in angularly disposed guides formed in a right and a left side frame of the car truck to allow linear movement of the beam when a braking force is applied.

Another railroad truck braking system associated with railroad car trucks includes a pair of elongated brake beams with similar brake shoes positioned on the opposite ends of each beam. To support each brake beam, one end of a pivot arm is attached to each brake shoe while an opposite end of the pivot arm is pivotally carried in a bracket located above the shoe and formed as part of each truck side frame. A center of the brake beam is slidably carried by a support spring to allow linear movement of the beam and thus engagement of the shoes with the truck wheelsets upon an application of a braking force to each beam.

SUMMARY OF THE INVENTION

A braking system of this invention for use with railroad car trucks having swingable wheelsets includes a front and a rear brake beam having attached at outer ends thereof brake shoes positioned to align and engage with a front and a rear wheelset of the car truck upon application of a braking force.

Each brake beam is pivotally connected respectively to a front and rear truck lever with the front brake beam attached to a bottom end of the front truck lever. The front truck lever is pivotally mounted intermediate its ends on a front swingable arm of the truck. The rear truck lever has a bottom end pivotally carried by a like bracket on a rear swingable arm of the truck with the rear brake beam attached to a center portion of the rear truck lever. To a top end of each truck lever is attached one end of front and rear connecting rods with opposite ends of each rod in turn connected to a transversely positioned floating lever.

By applying a braking force intermediate the ends of the floating lever, the braking force is distributed by the floating lever into force components and transferred by the front and rear connecting rods to cause a rotation of the front and rear truck lever. This rotation in turn results in movement of the brake beams so that the attached brake shoes engage the respective front and rear wheelsets.

The railroad braking system of this invention has several important advantages over known railroad braking systems.

Firstly, in order that the car truck function properly, each wheelset must be mounted for rotation horizontally about its vertical axis, as for example, when the railroad car travels along a curve in the track. When such rotation of the wheelsets occurs, the wheelset assumes a nonperpendicular or out-of-square position with respect to the longitudinal axis of the truck.

Activation of the braking system as constructed heretofore under conditions when the wheelset is in an out-of-square condition exerts forces tending to move and realign the wheelset to a squared condition.

This is undesirable because the realigning forces cause wheelset wear particularly when traversing curved track.

The braking system of this invention is constructed so that the braking forces do not affect the position of the wheelsets upon activation thereby to reduce wheelset wear.

Another feature of the present brake system is that the wheelsets are not unduly longitudinally displaced with respect to the side frame upon brake activation. Such displacement does not occur because the steering arm carries both the brake beam and the wheelset. As a result, slack adjusters provided to compensate for brake shoe wear may function properly.

DESCRIPTION OF THE PREFERRED EMBODIMENT

Figure 3:
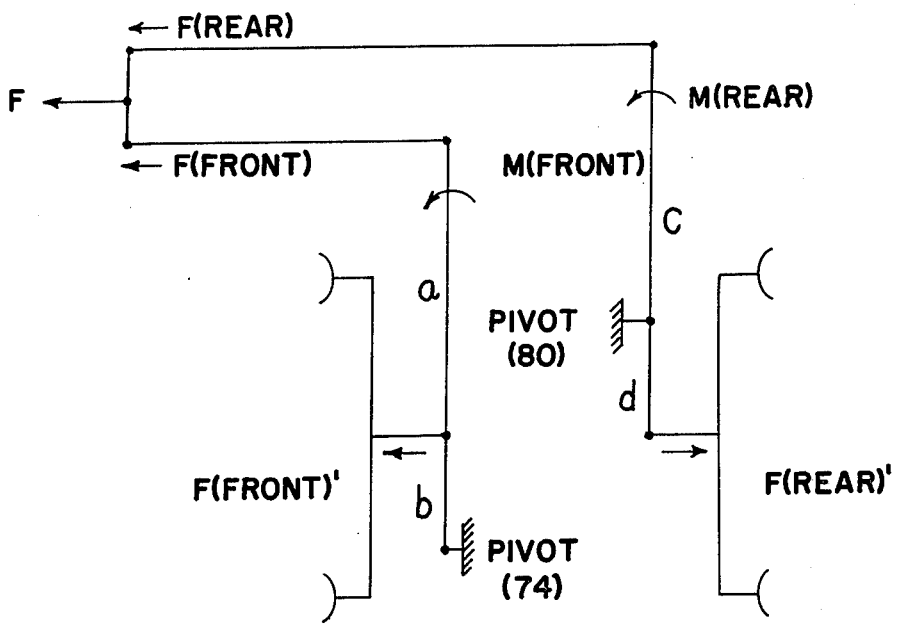
FIG. 3 is a schematic diagram of the braking system.
Figure 4:
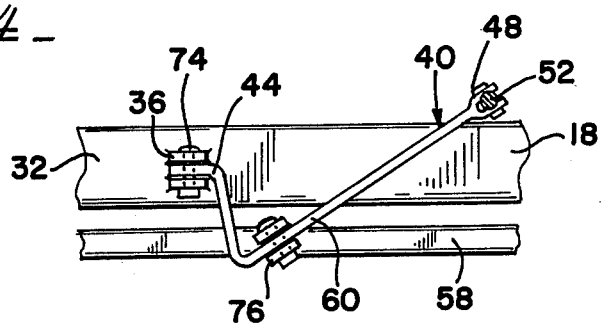
FIG. 4 is a fragmentary elevational view taken generally along the lines 4—4 of FIG. 1.

The braking system of the present invention may be more easily understood if it is considered as a system of forces as illustrated in FIG. 3 and to which reference is made.

A linear braking force F is applied in a direction as indicated by the arrow and is divided into two force components F (front) and F (rear) having the same direction as the force F. The forces F (front) and F (rear) are converted into rotational moments M (front) and M (rear) which are then reconverted into opposite and equal linear forces F (front)′ and F (rear)′.

Figure 1:
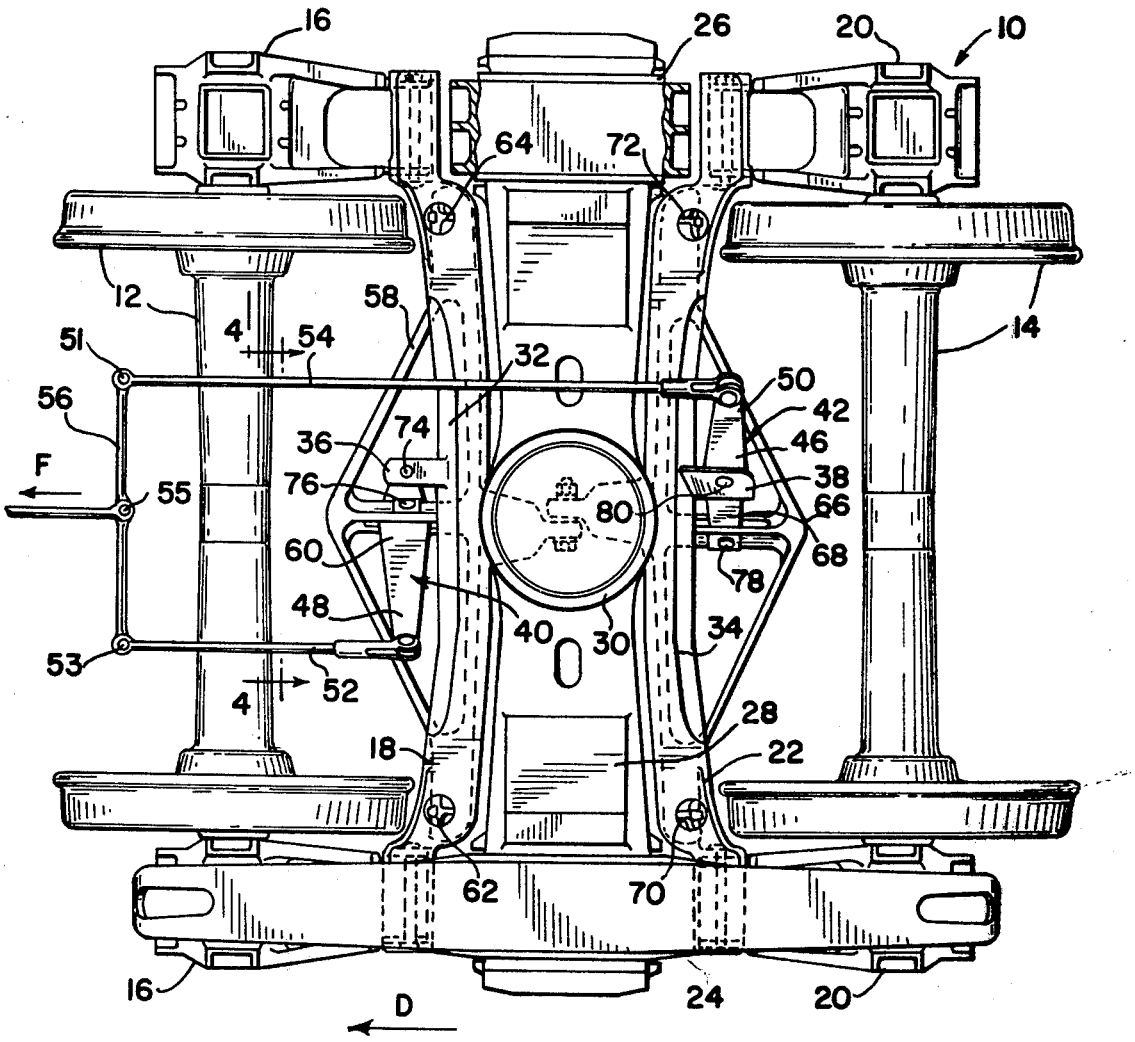
FIG. 1 is a plan view of a railroad truck incorporating the braking system of the present invention.
Figure 2:
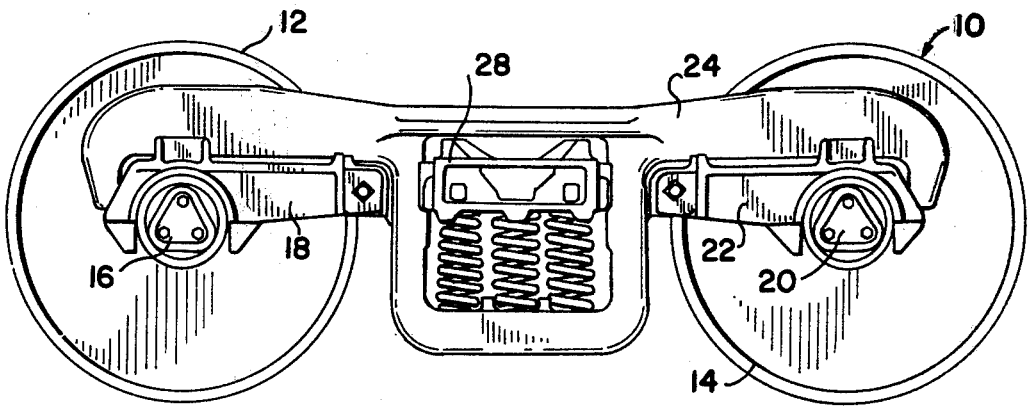
FIG. 2 is a side elevational view of the truck of FIG. 1.

This force system may be accomplished by a number of mechanical arrangements to create a braking system embodying the present invention. In the embodiment as shown in FIGS. 1 and 2, a brake system S is applied to a car truck 10 generally including a front wheelset 12 and a rear wheelset 14. The front wheelset 12 has axle ends 16 rotatably carried in a front generally U-shaped swingable arm 18. In a like manner, the rear wheelset 14 has axle ends 20 rotatably carried in an opposite facing generally U-shaped swingable arm 22.

The truck 10 further includes a pair of side frames 24, 26 and a transversely positioned bolster 28. The swingable arms 18, 22 are carried in the side frames 24, 26 in such a manner that each wheelset 12 and 14 and attached swingable arm 18 and 22 may rotate horizontally about its respective vertical axis so that a longitudinal axis of the wheelset, as an example the wheelset 12, takes an out-of-square position with respect to the longitudinal axis of the truck. For a more complete disclosure of the truck 10, reference is made to co-pending application Ser. No. 903,952 filed May 8, 1978 and assigned to the assignee of the present invention.

Assuming that the truck 10 is traveling in a direction designated by the arrow D in FIG. 1 and traverses a track section curving to the left relative to the direction of movement, the front wheelset 12 and front steering arm 18 rotate counterclockwise while the rear wheelset 14 and the rear steering arm 22 rotate clockwise about the respective vertical axis of each wheelset 12 and 14. In part, this opposite rotation occurs because the truck 10 is attached to the car body by a center plate 30 on the bolster 28 which is located an equidistance between the front and rear wheelsets 12 and 14 and aligned with the longitudinal axis of the truck 10.

To a center part 32 of the front swingable arm 16 and to a center part 34 of the rear swingable arm 22 are provided a front horizontal bracket 36 and a rear inclined bracket 38 in which there is pivotally carried a front truck lever 40 and a rear truck lever 42, respectively. The front truck lever 40 may be of a U-shaped configuration with a horizontal end segment 44 connected to the front bracket 36 of the front swingable arm 18.

The rear truck lever 42 may have an elongated configuration to be upwardly orientated with a middle section 46 of the rear truck lever 42 which is pivotally carried by the rear bracket 38 of the rear swingable arm 22. A top end 48 and 50 of each of the truck levers 40 and 42 is connected to an end of a front and rear connecting rod 52 and 54, respectively, which are positioned substantially parallel to the longitudinal axis of the truck 10 and thus perpendicular to the levers 40 and 42. The front and rear connecting rods 52 and 54 are so dimensioned that opposite ends of each rod 52 and 54 are aligned and are pivotally joined to a transversely positioned floating lever 56 by means of pivot pins 51 and 53. Means such as an air cylinder [not shown] for applying the linear braking force F is pivotally attached by means of pin 55 to a middle portion of the lever 56 intermediate the connecting pins 51 and 53.

A front brake rigging includes a front brake beam 58 pivotally connected adjacent to a middle portion 60 of the U-shaped front truck lever 40 with left and right front brake shoes 62 and 64 carried at each end of the front brake beam 58 aligned to engage the front wheelset 12. A rear brake rigging includes a rear brake beam 66 pivotally attached to a lower end 68 of the rear truck lever 42 with left and right rear brake shoes 70 and 72 carried at each end of the brake beam 64 aligned to engage the rear wheelset 14. Guide brackets [not shown] may be formed as part of the side frame 24, 26 to aid in positioning ends of the brake beams 58, 66 to ensure proper engagement.

As was noted earlier, the forces F (front)′ and F (rear)′ applied to the front and rear brake beams 58 and 66 are equal so as to promote uniform wear of the brake shoes 62, 64 and 70, 72 and provide like braking of each wheelset 12 and 14.

These forces F (front)′ and F (rear)′ are equal because the distances between the ends 48 and 50, the middle portions 60 and 46 and the opposite ends 44 and 68 of each truck lever 40 and 42 have been selected with respect to the magnitude of the force applied, i.e. F (front) and F (rear). In the exemplary embodiment, if the distance "a" is equal to the distance "c" while the distance "b" is equal to the distance "d" and twice the distance "a" and "c", the ratio of force F (front) to F (rear) proximates 1.5 to 1. By varying the magnitude of the forces F (front) and F (rear), any number of distance combinations can be provided to still maintain F (front)′ equal to F (rear)′.

It also should be pointed out that the connecting rods 52 and 54 and the floating lever 56 can be positioned on an opposite side of the truck 10, i.e. adjacent to the rear wheelset 14 rather than the front wheelset 12 by merely reversing the position of truck levers 40, 42, i.e. the U-shaped truck lever 40 is adjacent to the wheelset 14 while the elongated truck lever 42 is adjacent to the wheelset 12.

If the braking system is activated when the wheelsets 12 and 14 are in an out-of-square position with respect to the longitudinal axis of the truck 10, the force F does not affect this out-of-square position as the front brake shoes 62, 64 engage the front wheelset 12 and the rear brake shoes 70, 72 engage the rear wheelset 14. As an example, if the truck 10 encounters a left-hand curved section in trackage on which the car truck 10 is traveling in the direction D, the front wheelset 12 rotates counterclockwise while the rear wheelset 14 rotates clockwise. Because the front swingable arm bracket 36 is offset from the axis of rotation, the bracket 36 will likewise rotate causing a complementary change in position of the front brake beam 58 through the front truck lever 40. The truck lever 40 causes this change in position of the front brake beam 58 because a pivot 74 formed between the front bracket 36 and the truck lever 40 is vertical while a pivot 76 formed between the truck lever 40 and the front brake beam 58 is angularly inclined.

A similar condition exists between the rear swingable arm bracket 38, the rear truck lever 42 and the rear brake beam 66 where respective pivots 78, 80 are positioned parallel but angularly offset to a plane of rotation of the wheelset 14 so that a rotation of the rear wheelset 14 causes a complementary rotational movement of the rear bracket 38, the rear truck lever 42 and rear brake beam 66.

During operation, a linear braking force, as an example force F, is applied to the floating lever 56. The force F may be divided into two equal force components, as an example F (front) and F (rear), and transferred to the front and rear truck levers 40 and 42 by the connecting rods 52 and 54. The force components cause a rotation of the front and the rear truck levers 40 and 42 about the pivot 74, 80 formed with the front and rear swingable arm brackets 37 and 38. This rotation causes an equal but opposite linear force to be applied to the front and rear brake beams 58 and 66 so that the front brake shoes 62, 64 and the rear brake shoes 70, 72 engage the front and rear wheelsets 12 and 14 respectively.

While various modifications may be suggested by those versed in the art, it should be understood that I wish to embody within the scope of the patent warranted hereon all such modifications as reasonably and properly come within the scope of my contribution to the art.

What is claimed is:

1. A method of braking for use with a truck of a railroad car having swingable first and second wheelsets and first and second swingable arms in which said wheelsets are rotatably mounted, said method comprising the steps of:

(1) applying a linear braking force to a middle portion of a floating brake lever positioned transversely to a direction of said linear force, (2) dividing said linear force into a first and second force component and transferring said first and second force components to first and second elongated connecting rods having one end connected respectively to ends of said floating brake lever, (3) positioning said first and second connecting rods substantially parallel to said direction of said linear braking force, (4) transferring said first and second force components to a first and second truck lever having ends attached to opposite ends of said connecting rods respectively with said levers positioned substantially perpendicular to said connecting rods, (5) supporting an opposite end of said first truck lever from a pivot permanently mounted to said first swingable arm, (6) supporting a middle portion of said second truck lever from a pivot permanently mounted to said second swingable arm, (7) connecting a first braking device to a middle portion of said first truck lever and a second braking device to an opposite end of said second truck lever, (8) moving said ends of said first and second truck levers in said direction of said linear braking force with said first and second force components, (9) moving said first braking device in said direction of said linear braking force and said second braking device in an opposite direction, and

(10) engaging said first and second wheelsets with said first and second braking devices, wherein a horizontal rotation of said first or said second swingable arm causes a like rotation of said first or second braking device and is unaffected by activation of said braking force.

2. A method of braking a truck of a railroad car having a first and second wheelset rotatably carried in a first and second swingable arm respectively, said swingable arms carried in side frames of said truck so as to permit limited horizontal rotational movements between said side frames, said method comprising the steps of:

(1) positioning a first and a second truck lever in an upright orientation, (2) supporting a bottom end of said first truck lever in a pivot fixed to said first swingable arm, (3) supporting a middle portion of said second truck lever in a pivot fixed to said second swingable arm, (4) connecting a first braking device to a middle portion of said first lever arm, (5) connecting a second braking device to a bottom end of said second truck lever, (6) translating horizontal rotational movements of said first or second wheelset to said first or second braking device through said swingable arms and said truck levers attached thereto, (7) applying a linear braking force having a first direction proximately perpendicular to said levers to top ends of said truck levers to cause a rotation thereof, (8) converting said rotation of said first truck lever to a linear force having a direction proximating said first direction to move said first braking device in said first direction, (9) converting said rotation of said second truck lever to a linear force having a direction opposite said first direction to move said second braking device in an opposite direction, and

(10) engaging said first and second wheelsets with said first and second braking devices to cause a decrease in rotational velocity of said wheelsets, wherein said braking force may be applied without unduly changing a horizontal position of said wheelsets with respect to said side frames.

3. A braking system for a railroad car truck having a transversely positioned bolster supported at its ends in a right side frame and left side frame and a front and a rear wheelset rotatably mounted in a front swingable arm and a rear swingable arm, respectively, said arms being connected to said side frames to allow relative movement of said swingable arms with respect to said side frames, said system comprising, means for supplying a braking force, said means connected to said braking system, means for dividing said braking force into a first and second force component, first and second connecting means for transferring said force components respectively, first and second lever means connected to said first and second connecting means for converting said force components to a first and second rotatable moment, a first pivot means provided on said first swingable arm and connected to an opposite end of said first truck lever and a second pivot means provided on said second swingable arm and connected to a middle portion of said second truck lever, and first braking means and second braking means engageable with said first wheelset and said second wheelset, respectively, for applying a braking force thereto, said first braking means pivotally connected intermediate the ends of said first lever means and said second braking means pivotally connected at an opposing end of said second lever means, whereby said first braking means and said second braking means move horizontally with respect to horizontal movements of said swingable arms and remain aligned with said wheelsets upon an application of said braking force.

4. A braking system for a railroad car truck comprising, a truck body, a left and right side frame carried by said body, a front swingable arm and a rear swingable arm resiliently engaged with said side frames to allow limited horizontal rotational movements of said swingable arms with respect to said side frames, a front wheelset and a rear wheelset each having axle ends rotatively carried in ends of said front and rear swingable arms respectively, an upwardly oriented front truck lever having a lower end pivotally attached in a bracket intermediate ends of said front swingable arm, an upwardly oriented rear truck lever pivotally mounted intermediate its ends to a bracket provided on a center part of said rear swingable arm, a front braking device including a front brake beam and a right brake shoe and a left brake shoe carried at ends of said beam, said beam pivotally connected to a center portion of said front truck lever with said shoes aligned to engage with said front wheelset, a rear braking device including a rear brake beam and a right brake shoe and a left brake shoe carried at ends of said beam, said beam pivotally connected to a bottom of said rear brake lever with said shoes aligned to engage with said rear wheelset, a front connecting rod and a rear connecting rod positioned substantially parallel to said front rod with said rods positioned substantially perpendicular to said truck levers, said rods each having one end thereof connected to a top end of said front and rear truck levers respectively, and a floating brake lever positioned transversely to said connecting rods and having ends connected to opposite ends of each said connecting rod respectively, wherein a horizontal position of said front swingable arm or rear swingable arm with respect to said side frame remains unaffected by an application of a braking force to said floating brake lever to activate said system.

5. A braking system as defined by claim 4 and further characterized by, said front truck lever having a horizontal end segment joining with said front swingable arm bracket to form a vertical pivot, said middle portion of said front truck lever being at an elevation below said vertical pivot with said front brake beam attached to said middle portion adjacent to a brite of said truck lever to align proximately horizontally with said rear brake beam.

6. A method of braking for use particularly with railroad car trucks having swingable wheelset means, comprising the steps of:

(1) supplying a braking force having a first linear direction, (2) dividing said braking force into a first force component and a second force component each having a direction proximating said braking force direction, (3) converting said first force component and said second force component into a first rotational moment and a second rotational moment by applying said force components to an end of a first and a second truck lever respectively, (4) rotating with said first rotational moment said first truck lever about a pivot formed between an opposite end of said first truck lever and a bracket carried by a first swingable arm of said swingable wheelset means, (5) rotating with said second rotational moment said second truck lever about a pivot formed at a point located between said end and an opposite end of said second truck lever and a bracket carried by a second swingable arm of said swingable wheelset means, (6) converting respectively said rotation of said first truck lever and said second truck lever into a third linear force and a fourth linear force having proximately equal magnitudes but opposite directions, and (7) applying said third linear force to a first braking device carried by said first truck lever at a point located between said end and said opposite end and said fourth linear force to a second braking device carried by said second truck lever at said opposite end to engage said wheelsets and cause a decrease in rotational velocity of such.

7. A brake rigging for a railroad car truck including a front and a rear wheelset having axle ends rotatively carried by a front and a rear U-shaped swingable arm, respectively, said swingable arms having side portions being joined to ends of a pair of spaced side frames such that said front wheelset with said front swingable arm and said rear wheelset with said rear swingable arm may rotate about a vertical axis of said respective wheelset, and a transversely positioned bolster having ends respectively carried in a pocket formed in a middle portion of each said side frame, said brake rigging further comprising, a front truck lever carried in a pivot connection formed in part by said front swingable arm with a center of said pivot connection proximately aligning with a longitudinal axis of said front swingable arm, a front braking device carried by said front truck lever a first distance from said pivot connection, said device including a pair of spaced brake shoes engageable with wheels of said front wheelset, front operative means connected to said front truck lever at a distance greater from said pivot connection than said first distance, said means prepared to selectively rotate said front truck lever to engage said front brake shoes with said front wheels, a rear truck lever carried in a pivot connection formed in part by said rear swingable arm with a center of said pivot connection proximately aligned with a longitudinal axis of said rear swingable arm, a rear braking device carried by said rear truck lever on one side of said pivot connection, said device including a pair of spaced brake shoes engageable with wheels of said rear wheelset, and rear operative means connected to said rear brake lever on a side opposite said pivot connection, said means prepared to selectively rotate said rear truck lever to engage said rear brake shoes with said rear wheels.

8. A brake rigging as defined by claim 7 and further characterized by, said front and said rear braking devices being positioned below said front and said rear swingable arms, and said front and said rear operative means being positioned above said front and said rear swingable arms.

* * * * *